US005875914A

United States Patent [19]

Nguyen et al.

[11] Patent Number: 5,875,914

[45] Date of Patent: Mar. 2, 1999

[54] CONTAINER WITH INTEGRAL ENDPIECE AND SEALING MEMBER

[75] Inventors: Tuan A. Nguyen; Howard Curtis Chasteen, both of Golden; Michael Duane Richardson, Louisville, all of Colo.

[73] Assignee: Ball Corporation, Broomfield, Colo.

[21] Appl. No.: 928,738

[22] Filed: Sep. 12, 1997

Related U.S. Application Data

[63] Continuation-in-part of Ser. No. 824,244, Mar. 25, 1997.

[51] Int. Cl.[6] ..... B65D 41/48; B65D 17/40

[52] U.S. Cl. ..... 220/276; 220/279; 220/280; 220/310.1

[58] Field of Search ..... 220/267, 270, 220/276, 260, 310.1, 309.1, 309.2, 366.1, 277, 279, 280, 806, 378, 619, 620

[56] References Cited

U.S. PATENT DOCUMENTS

| | | | |
|---|---|---|---|
| Re. 8,126 | 3/1878 | Wilson, Jr. . | |
| 205,677 | 7/1878 | Porter . | |
| 1,622,236 | 3/1927 | Gunter | 220/277 |
| 1,734,378 | 11/1929 | Hildebrandt . | |
| 1,860,201 | 5/1932 | Punte . | |
| 2,277,066 | 3/1942 | Bogner . | |
| 2,382,378 | 8/1945 | Bloedorn . | |
| 2,535,839 | 12/1950 | Coyle et al. . | |
| 2,843,650 | 7/1958 | Jacquier . | |
| 2,940,633 | 6/1960 | Thacker . | |
| 3,223,063 | 12/1965 | Payton . | |
| 3,224,627 | 12/1965 | Dielmann et al. . | |
| 3,228,552 | 1/1966 | Rutledge . | |
| 3,460,709 | 8/1969 | Bieder et al. | 220/277 |
| 3,720,347 | 3/1973 | Stoffregen . | |
| 3,721,365 | 3/1973 | Saunders . | |
| 3,930,593 | 1/1976 | Ragettli | 220/276 |
| 3,942,675 | 3/1976 | Hasegawa . | |
| 4,301,939 | 11/1981 | Pupp . | |
| 4,427,128 | 1/1984 | Heyn | 220/270 |
| 4,545,494 | 10/1985 | Sawicki . | |
| 4,660,735 | 4/1987 | Peschardt et al. . | |
| 4,934,554 | 6/1990 | Edwards . | |
| 4,951,836 | 8/1990 | Yoshimura et al. . | |
| 5,042,680 | 8/1991 | Argudo et al. . | |
| 5,115,934 | 5/1992 | Nelson | 220/276 |
| 5,178,297 | 1/1993 | Harold . | |
| 5,271,517 | 12/1993 | Bowers | 220/276 |

FOREIGN PATENT DOCUMENTS

| | | |
|---|---|---|
| 638233 | 3/1962 | Canada . |
| 103621 | 3/1964 | Norway . |
| 616596 | 1/1949 | United Kingdom . |
| 266019 | 4/1950 | United Kingdom . |
| 733833 | 7/1955 | United Kingdom . |

*Primary Examiner*—Stephen K. Cronin
*Assistant Examiner*—Nathan Newhouse
*Attorney, Agent, or Firm*—Sheridan Ross P.C.

[57] ABSTRACT

An open-ended container body is covered, preferably sealingly, by an endpiece/sealing-member. An annular flange of the endpiece/sealing-member is captured by crimping with a container body flange. The endpiece/sealing-member flange is coupled to the remainder of the endpiece/sealing-member by a tear strip which, upon removal, permits the remainder of the endpiece/sealing-member to be fully or partially removed from the open end of the container. The tearstrip is preferably integrally formed with the remainder of the endcap.

18 Claims, 8 Drawing Sheets

CONTAINER WITH INTEGRAL ENDPIECE AND SEALING MEMBER

The present invention is a continuation in part of Ser. No. 08/824,244 (Attorney File No. 1604-162-1) of Tuan A. Nguyen et al., for "CONTAINER WITH SEALING MEMBER" filed Mar. 25, 1997 incorporated herein by reference.

The present invention generally relates to a container and, in particular, container having a container body with an attached endpiece/sealing member.

BACKGROUND INFORMATION

Various types of closures exist for containers. One common closure is a metal endpiece having a push-down tab or the like formed in its central panel and sized substantially less than the central panel. This type of endpiece is typically attached to an open end of a metal container body by a seaming operation, e.g., to provide a double seam between the end piece and the container body. Such closures are commonly used for both beverage and food containers. Re-sealing of such containers after opening the push-down tab typically involves use of a plastic over-cap separate from the endpiece.

Another common type of closure is a metal endpiece attached to a container body which may be formed from metal or composite materials (e.g., for various food products, including snack foods such as potato chips). A panel which is substantially the same size as the diameter of the container body is formed in the end piece and may be completely removed from the end piece by engaging an appropriate pull-tab or the like. In many of these designs, the remainder of the end piece provides some resistance or impediment to flow or removal of contents and/or presents sharp edges which may raise safety concerns. Re-sealing of such containers after removal of the panel typically involves use of a plastic over- cap separate from the end piece.

Removable plastic or foil membranes have also been utilized to seal various foodstuffs within a container. A plastic over-cap is typically involved in re-sealing the container after removal of a foil membrane.

Seals have also been provided between an end piece and a container body via some type of sealing member which is disposed between and separate from both the end piece and the container body. One type of sealing member which has been utilized is a sealing member strip which compressively engages a portion of the end piece against the container body. When removal of the end piece is desired, tension in the sealing member is increased to rupture a portion of the end piece engaged by the sealing member. This leaves the fractured portion of the end piece attached to the container body by the sealing member, and allows removal of the remainder of the end piece from the container body.

Another type of sealing member which has been commonly used in the juice industry is a simple plastic seal strip which is disposed between a metal end piece and a composite container body. The plastic sealing strip is pulled out from between the two members when removal of the end piece is desired.

SUMMARY OF THE INVENTION

The present invention generally relates to a sealing member which is preferably integrally formed with an endpiece. The integral endpiece/sealing-member provides at least one closure, preferably a sealing closure, of the container body. The integral endpiece/sealing-member is coupled to the container body to resist removal of the endpiece/sealing-member. Upon removal of a portion of the endpiece/sealing-member, preferably facilitated by a tear score, a remaining portion of the endpiece/sealing-member can be moved away from the container body to dispense or remove contents from the container body (e.g., the endpiece/sealing-member portion may be totally removed from the container body, or the endpiece/sealing-member may be hingedly interconnected with the container body such that it remains attached to the container body even after opening).

In one aspect, an integral endpiece/sealing-member is used in connection with a container body having a sidewall which is disposed about a container center axis (e.g., a central, longitudinal reference axis). Appropriate configurations for the container body sidewall include, but are not limited to, cylindral, oval-shaped, elliptical, rectangular, and square. The container body further includes a container body flange which is generally disposed on a first open end of the container body (e.g., the container body may have another open end which is closed by a separate endpiece, or the opposite end of the container body may be closed by being integrally formed with the container body sidewall as in the case of a drawn and ironed container body). The body flange is radially spaced relative to at least a portion of the sidewall (e.g., the container body flange may be disposed further from the container center axis than a corresponding portion of the sidewall, or the container body flange may be disposed closer to the container center axis than a corresponding portion of the container body sidewall). The body flange is separated from an opposed portion of the container body sidewall by a first space. The container body flange and the corresponding portion of the sidewall may be integrally formed and define a generally inverted U-shaped structure with the container body flange having a free end which is generally directed away from the first open end of the container body. Having the container body flange disposed radially outward relative to the corresponding portion of the container body sidewall and utilizing the above-noted generally U-shaped structure provides an upper portion for the sidewall of the container body which is free from any edges which could potentially impede the flow out of the container body.

The integral endpiece/sealing-member is attached to the container body and closes its first open end. The integral endpiece/sealing-member and container body may be separately formed, and may be formed from different materials.

The integral endpiece/sealing-member includes a first wall covering the container body open end and an endpiece/sealing-member flange which is disposed at least partially between the container body flange and a portion of the container body sidewall. The endpiece/sealing-member flange is coupled to the container body such as by being compressed or captured between the container body flange and the container body sidewall.

The endpiece/sealing-member first wall and endpiece/sealing-member flange are preferably integrally formed. The integral endpiece/sealing-member flange has a free end which is generally directed in the same direction as that in which the first open end of the container body projects (e.g., the free end of the endpiece/sealing-member flange may point or project in the same general direction as the first open end of the container body).

A tear strip portion of the integral endpiece/sealing-member connects the endpiece/sealing-member flange to the remainder of the integral endpiece/sealing-member so that when the endpiece/sealing-member tear strip is removed, the endpiece/sealing-member flange is no longer coupled to the integral endpiece/sealing-member. To facilitate removal of the tear strip portion of the endpiece/sealing-member, the tear strip is preferably provided with a handle disposed on the exterior of the container so as to be accessible by a consumer to at least assist in rupturing and/or removing the tear strip portion. Removal or rupturing of the tear strip portion is further facilitated by one or more scores or other weakened lines or areas such as a score between the tear strip portion and the flange and/or a score between the tear strip portion and a rim portion of the integral endpiece/sealing-member.

One aspect of the present invention relates to a method for attaching an integrated endpiece/sealing-member to the container body. In one embodiment, the method includes forming a first hooked portion on a free end of the container body, generally on the first open end of the container body, and forming a second hooked portion on a free end of the integrated endpiece/sealing-member. The endpiece/sealing-member is disposed relative to the first open end of the container body such that the hooked portion of the integrated endpiece/sealing-member may be moved relative to the hooked portion of the container to move the two hooked portions towards each other to at least assist in attaching the endpiece/sealing-member to the container body. In one embodiment, a rolling process is used to compress the two hooked portions against the container sidewall, capturing and compressing the endpiece/sealing-member flange between the body flange and the body sidewall.

DETAILED DESCRIPTION

Figure 1:
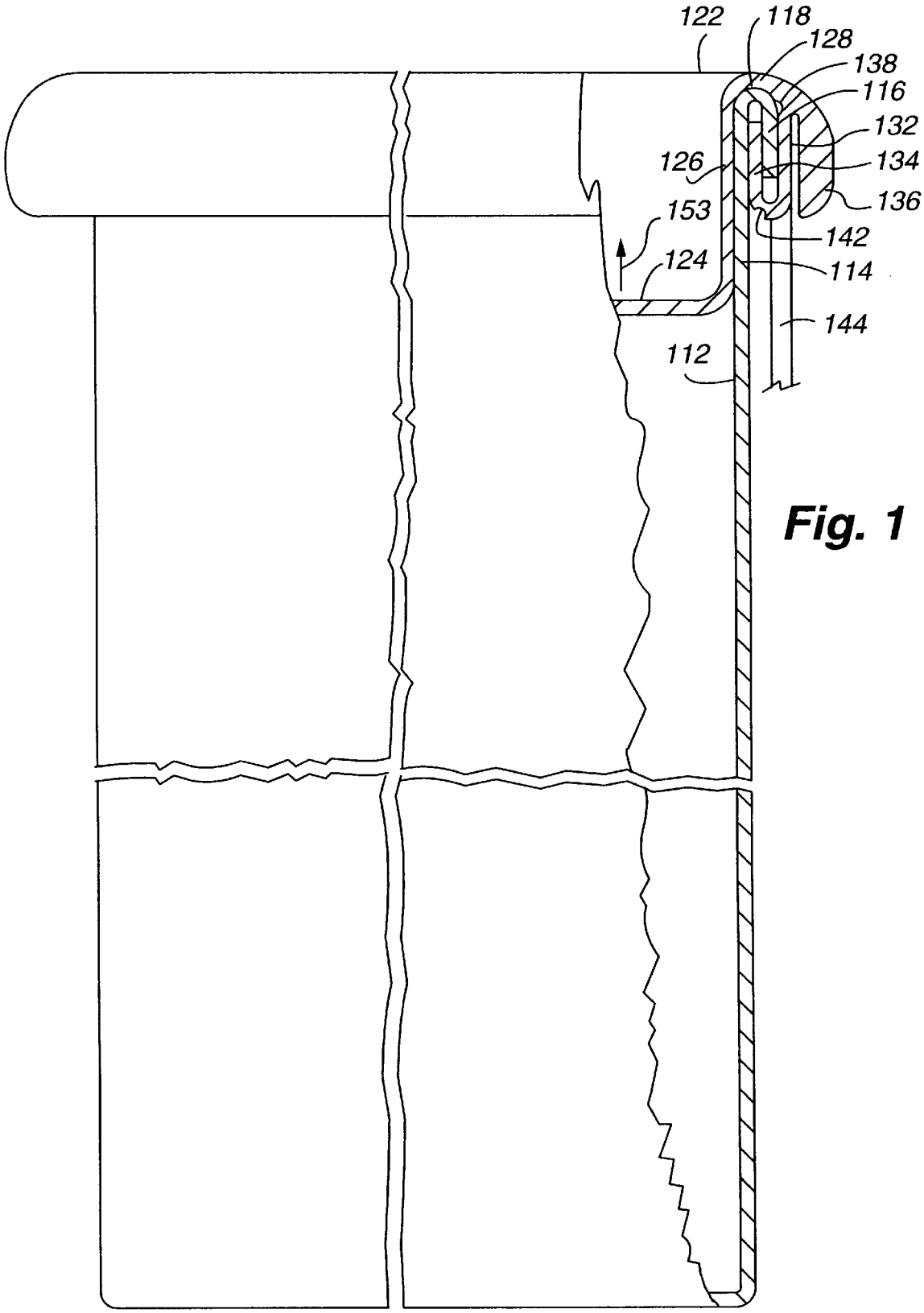
FIG. 1 is an elevational view, partially in cross section of a container body and integral endpiece/sealing-member according to an embodiment of the present inventions.

In the embodiment depicted in FIG. 1, a container body 112 includes a sidewall 114 with the free end formed into a flange 116 forming a cross section shaped in an inverted "U" defining a container rim 118. The opening at or near the container rim 118 is covered by an integral endpiece/sealing-member 122. The endpiece/sealing-member 122 contains a first wall 124 generally extending laterally across the container 112, a second wall 126 generally adjacent an upper portion of the container sidewall 114, an end cap rim 128 generally adjacent the container body rim 118, a tear strip portion 132 connecting an endpiece/sealing-member flange 134 with the remainder of the endpiece/sealing-member 122 and a lip 136 generally surrounding and covering the tear strip portion 132. Although a number of container configurations are possible, when the container is to be generally cylindrical, the container sidewall 114, flange 116, endpiece/sealing-member second wall 126, tear strip portion 132, endpiece/sealing-member flange 134 and endpiece/sealing-member lip 136 will have a generally cylindrical or annular shape.

As seen in FIG. 1, the endpiece/sealing-member 122 contacts the inner surface or end of the container sidewall along the second endpiece/sealing-member wall 126 and rim 128. This contact provides the desired degree of closure of the container body. Different degrees of closure may be desired for different purposes. In some situations, typically nonfood situations, closure which is merely sufficient to generally prevent loss of contents may be sufficient. In another use, a higher degree of closure such as a sealing of the container may be desired. Different degrees of sealing may be desired for different uses, including liquid-tight sealing, gas-tight or hermetic sealing and the like. Closure or sealing may be achieved by providing tight press or interference fit between the endpiece/sealing-member and the container such as between the endpiece/sealing-member second wall 26 and/or rim 128 and adjacent portions of the container sidewall or some amount of adhesive-based, film-based, gasket-based or integral (such as heat welded or otherwise fused) sealing may be provided for various purposes. In general, sealing for foodstuffs and beverages will use a gas-tight seal, a pressure-tight or a vacuum-tight seal.

Both to preserve the desired containment feature and a desired degree of sealing, the endpiece/sealing-member 122 is coupled to the container body so as to avoid premature removal of the endpiece/sealing-member, preferably in a fashion which will make apparent attempted end cap removal or other tampering with the container. In the embodiment depicted in FIG. 1, removal of the endpiece/sealing-member is resisted by the capture of the endpiece/sealing-member flange 134 between the container body sidewall 114 and container body flange 116. Capturing the endpiece/sealing-member flange 134 is effective to resist endpiece/sealing-member removal because the endpiece/sealing-member flange 134 is coupled to the remainder of the endpiece/sealing-member 122 by the tear strip 132.

When removal of the endpiece/sealing-member 122 is desired, e.g., for providing access to the interior of the container and its contents, the endpiece/sealing-member 122 removal may be permitted by severing some or all of the connection between the endpiece/sealing-member flange 134 and the remainder of the endpiece/sealing-member.

Figure 2:
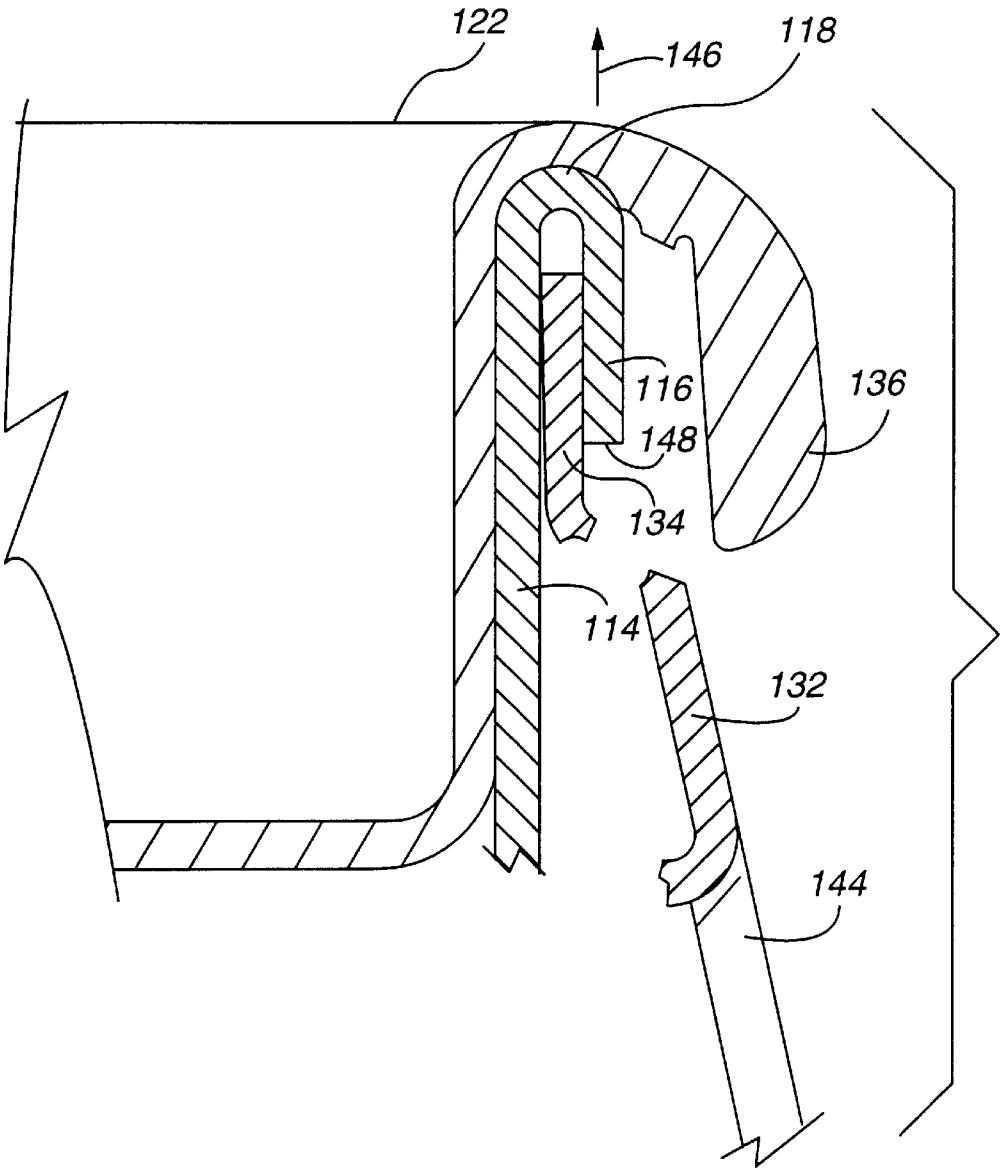
FIG. 2 is a partial cross sectional view of the container of FIG. 1 showing the tear strip detached.

When it is desired to remove the endpiece/sealing-member 122, in the embodiment of FIG. 1, the tear strip 132 is removed. Removal of the tear strip is facilitated by score lines 138, 142 and by a handle portion 144. As depicted in FIG. 2, when the handle 144 is pulled, the tear strip portion 132 ruptures along the lines defined by the score lines 138, 142 severing some or all of the connection between the endpiece/sealing-member flange 134 and the remainder of the endpiece/sealing-member 122. As a result of such severing the endpiece/sealing-member flange 134 (which is still captured between the container body flange 116 and container body sidewall 114) no longer serves to restrain removal of the endpiece/sealing-member 122. Thus the remaining portion of the endpiece/sealing-member 122 can be removed from the container body by lifting upward 146. As seen in FIG. 2, even after the tear strip 144, 132 is removed, the (potentially sharp) end 148 of the container body flange 116 is covered by the lip 136 of the endpiece/sealing-member 122. Moreover, the lip 136 provides a convenient region for grasping the endpiece/sealing-member 122 to facilitate removal 146. As will be apparent from FIG. 2, upon removal 146 of the endpiece/sealing-member 122, the end 118 of the container body will be defined by an outwardly turning flange 116 so that there will be substantially no edges, flanges or other impediments to outward flow or removal of contents from the container body.

Figure 3:
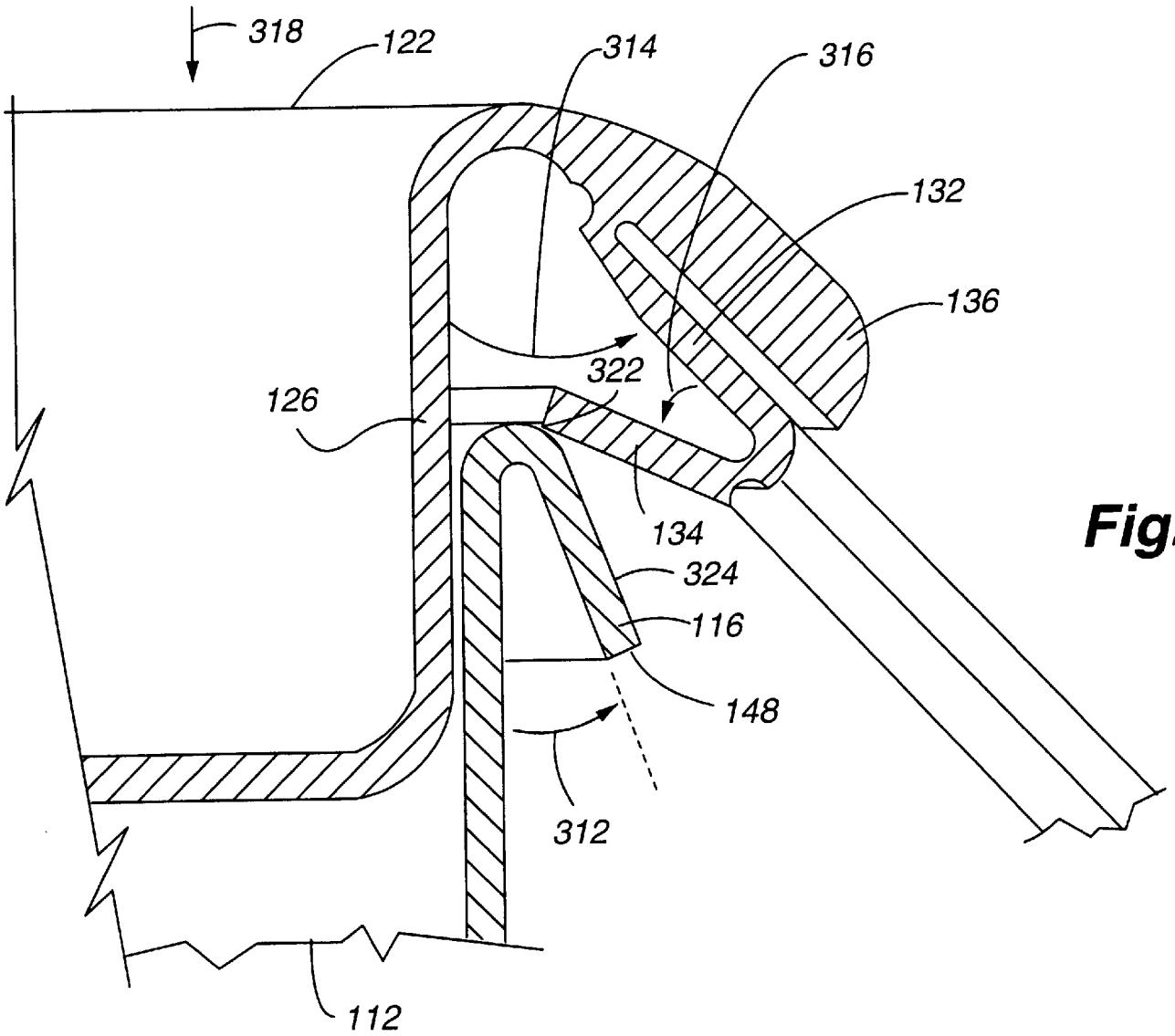
FIG. 3 is a partial cross sectional view of a container body and integral endpiece/sealing-member during a stage of fabrication according to an embodiment of the present invention.

As depicted in FIG. 3, according to one procedure for fabricating a container, the container body is initially formed with the flange 116 flared outward 312 (compared to its final attitude, depicted in FIG. 1). The endpiece/sealing-member 122, at this stage of fabrication, is, in the depicted embodiment, configured such that the tear strip portion 132 and lip 136 are flared outward 314 with respect to the endpiece/sealing-member second wall 126 (compared to their final attitude shown in FIG. 1). The endpiece/sealing-member flange 134 is preferably flared inward 316 with respect to the tear strip 132 (compared to their respective attitudes in the final configuration depicted in FIG. 1).

The endpiece/sealing-member 122 is moved 318 toward the open end of the container body and, in the fabrication stage depicted in FIG. 3, is situated so that the endpiece/sealing-member flange 134 contacts the outer surface of the body flange 116 and is located above and somewhat radially outward of the body flange 116. Continued movement 318 of the endpiece/sealing-member 122 with respect to the container body 112 results in deflection of one or both of the endpiece/sealing-member flange 134 and/or body flange 116. The relative amounts of deflections will depend on the materials used and the particular flange endpiece/sealing-member geometry provided. It is anticipated, however, that the endpiece/sealing-member flange 134 and, to some extent, endpiece/sealing-member tear strip 132 and lip 136 will deflect radially outward permitting the endpiece/sealing-member 122 to move downward 318 while the edge or rim 322 of the endpiece/sealing-member flange 134 resiliently deflects sufficiently to slide or move down the flared outer surface 324 of the container body flange 116. Flange deflection continues as the endpiece/sealing-member 132 is moved downward 318 until the endpiece/sealing-member flange 134 edge 322 clears the edge 148 of the container flange 116, at which time, resilience of the endpiece/sealing-member 122 allows the flange 134 and, to some extent, the tear strip 132 and lip 136 to relax to the configuration depicted in FIG. 4 with the end or rim 322 of the endpiece/sealing-member flange 134 radially inward of the container body flange 116. From the configuration depicted in FIG. 4, the container can be changed to the configuration depicted in FIG. 1 by crimping, pressing or folding the body flange 116, tear strip 132 and lip 136 radially inward. In one embodiment, a chuck or support (not shown) is positioned radially interior of the endpiece/sealing-member second wall 126, generally in the recessed space 412 defined by the public surface of the endpiece/sealing-member 122. A roller such as a circumferentially traveling roller or other crimping or compressing device (not shown), of types known to those skilled in the art compresses or folds the lip 136 and tear strip 132 radially inward 414 causing the attached endpiece/sealing-member flange 134 to move radially in and upward 416 into the space 418 between the container body flange 116 and the upper portion of the container body sidewall 114. Further radial folding or crimping 414 of the lip 136 and tear strip 132 transfers radially inward force to the container body flange 116 causing it to move radially inward 422 to compress and capture the endpiece/sealing-member flange 134 as described above and as depicted in FIG. 1.

The endpiece/sealing-member may be formed from a number of materials and, in one embodiment, is formed from a plastic of a type typically used in connection with food containers such as polypropylene and/or polyethylene. In situations where the container may be subjected to relatively high temperatures, such as situations in which the container, including endpiece/sealing-member may be pasteurized or subjected to a retort, a plastic with a higher temperature tolerance such as PET (polyethylene terephthalate) may be used.

Figure 4:
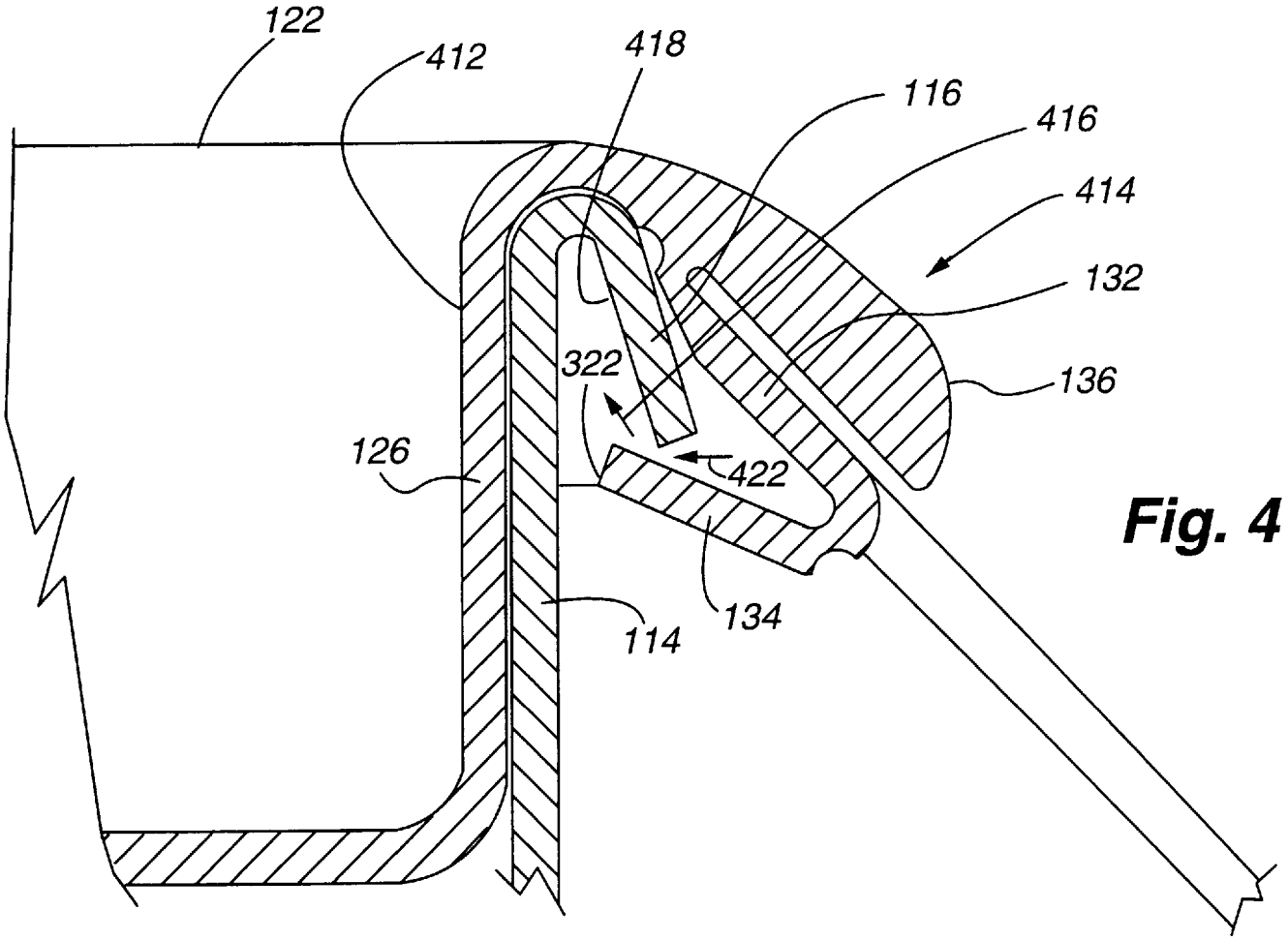
FIG. 4 is a partial cross sectional view corresponding to FIG. 3 but showing a later stage of fabrication according to an embodiment of the present invention.
Figure 5:
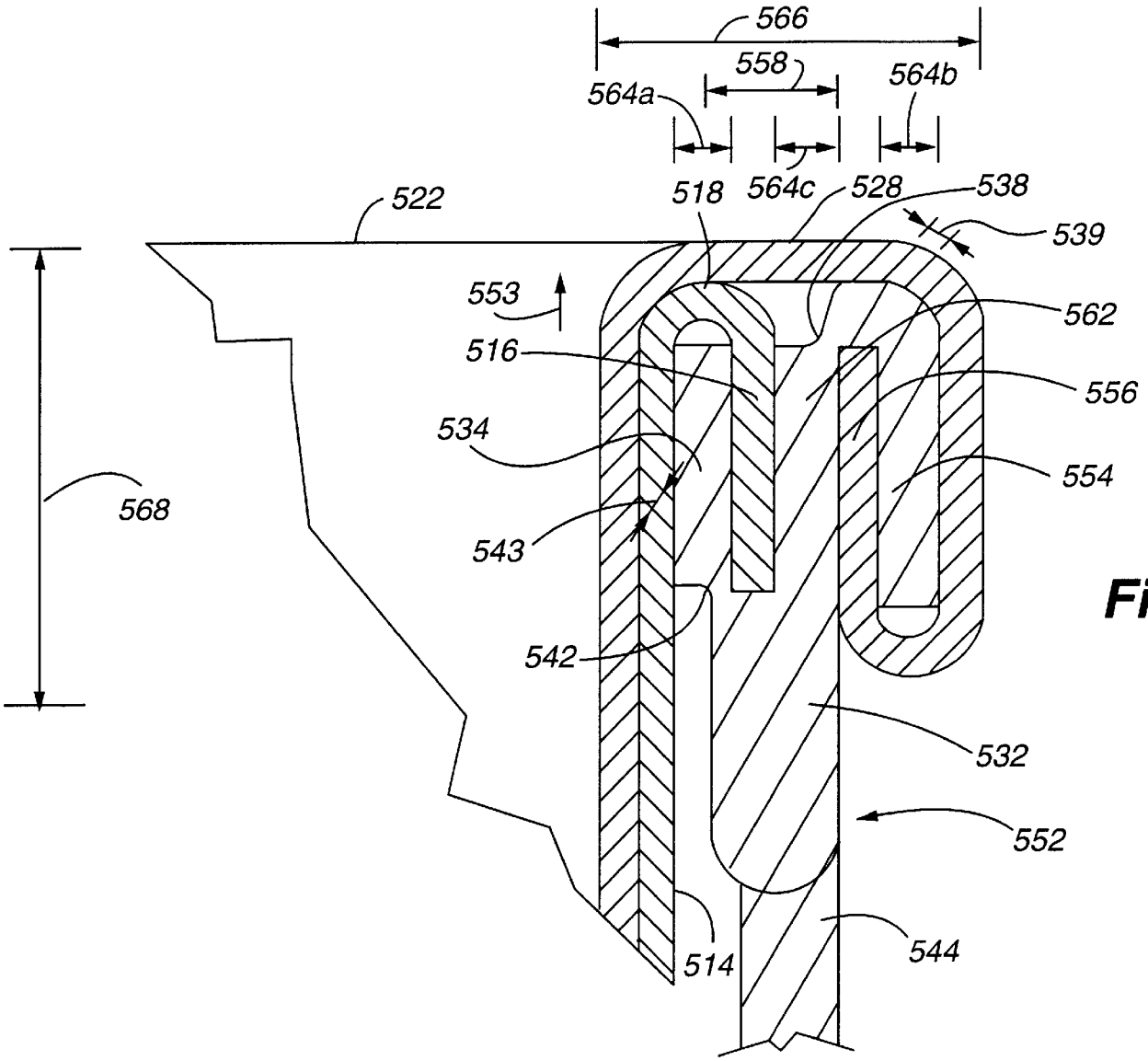
FIG. 5 is a partial cross sectional view of a container with a non-integral end cap and sealing member.

In the embodiment of FIG. 5, a sealing strip is provided which is non-integral with an endcap 522. In the embodiment of FIG. 5, rather than providing an integral sealing member, the sealing member 552 is non-integral and is mechanically coupled to the endcap 522 such as by having a second flange portion 554 compressed and captured by a hook-forming endcap flange 556. As with the embodiment of FIGS. 1–4, a container body flange 516 compresses and captures a first sealing member flange 534 to couple the sealing member and thus the endcap to the container body. In this way the sealing member 552 is coupled to both the container body sidewall and the endcap 522 so that, in the absence of rupturing of the sealing member 552, the sealing member 552 acts to resist removal of the endcap 522.

When removal of the endcap 522 is desired, at least a portion of the sealing member 552 is ruptured to at least partially decouple the container body from the endcap. A number of features of the sealing member 552 are preferably present to assist in the desired rupturing. Weakened regions 542, 538, which preferably extend around some or all of the perimeter of the container, define regions of preferential rupturing in a response to a tension force applied to the tearstrip 532 (e.g. by grasping and pulling the handle 544). In one embodiment, the effective thicknesses 539, 543 of the sealing strip 552 in the region of the weakened areas 542, 538 respectively is (about 0.1 mm). In the embodiment of FIG. 5, the weakened regions appear, prior to rupture, as curved or angled portions rather than as score lines, although score lines can be provided if desired. Desired rupturing is further facilitated by the relative position of the edge of flange 516 with respect to the weakened portion 542 and the relative position of the edge of flange 556 with respect to the weakened portion 538. In both cases, the flange edges are positioned to act in a shearing or scissoring fashion to assist in rupturing. Another feature facilitating rupturing in the desired fashion is the relatively thickened configuration of the tearstrip 532 such as having a thickness 558 in the radial direction which reduces the likelihood of rupture or tearing in undesired locations, i.e., locations other than those adjacent the weakened regions 542, 538. In the depicted embodiment, the tearstrip 532 has a thickness 558 such that a portion of the tearstrip 532 extends radially inward beyond the effective radius of the container body flange 516. The enhanced thickness 558 helps assure that the tearstrip 532 will be removed as a single piece and provides decreased likelihood of premature rupturing or tearing (before the desired extent of tearstrip removal or rupturing). In one embodiment, a thickness of about 0.020 inches (about 0.5 mm) is provided. In contrast, in one embodiment the thickness of the first and second flanges of the tearstrip 534, 554 and the upper (inter-flange) portion of the tearstrip 562 may be about 0.012 inches (about 0.3 mm) 564*a,b,c*. In one embodiment, the rim region of the endcap has a radial extent 566 of about 0.078 inches (about 2 mm) and an axial extent or height of about 0.10 inches (about 2.5 mm) 566, 568.

A number of materials can be used in connection with the embodiment of FIG. 5. Preferably the tearstrip 532 is formed of a plastic material such as that described for the integrated endcap/sealing member of FIGS. 1–4, and the endcap 522 is made of a metallic material such as steel, aluminum, alloys or the like.

A number of fabrication procedures can be used in connection with the embodiment of FIG. 5. In one embodiment, the sealing member 552 may first be coupled by crimping or compressing the endcap flange 556 against the second sealing member flange 552 e.g. using a press or rolling procedure and, thereafter, the coupled but non-integral endcap/sealing-member can be coupled to the body 514 in a fashion similar to that disclosed above for coupling of the integrated endcap/sealing-member to the container body, as depicted in FIGS. 3–4. Alternatively, the sealing member 552 may be first coupled to the container body 514 and thereafter coupled to the endcap 522, or the various members may be coupled together using procedures similar to those discussed in Ser. No. 08/824,244, supra.

Figure 6:
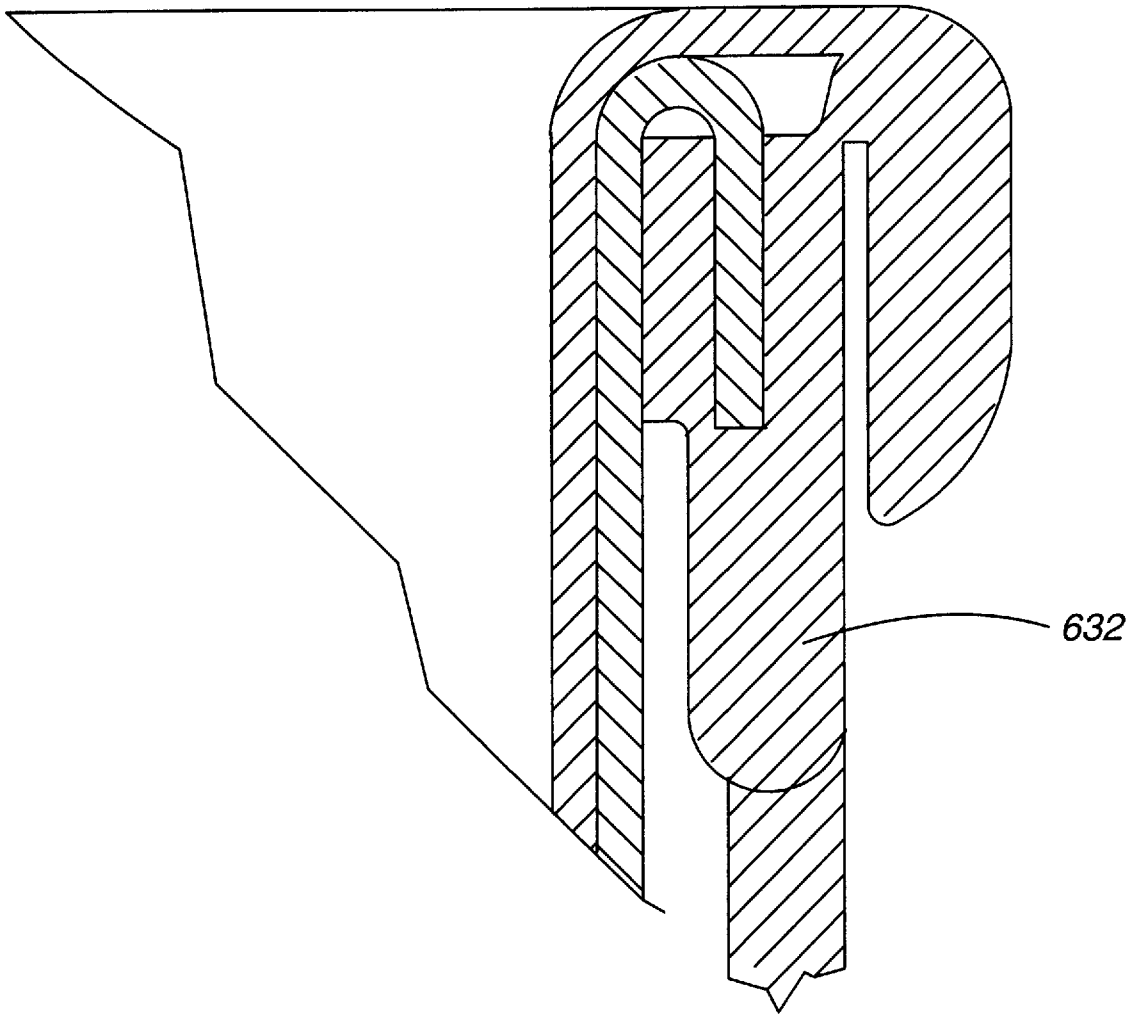
FIG. 6 is a partial cross-sectional view of a container with an integral end cap/sealing member.

FIG. 6 depicts an embodiment similar to FIG. 5 but in which a thickened tearstrip portion 632 is provided in connection with an integral sealing member/endcap.

Referring once again to FIG. 1, it can be seen that if the contents of the container 112 are pressurized, the internal pressure will exert a force on the endpiece/sealing-member 122 in a direction that is vertically upwards 153, (in the view of FIG. 1). Since, as noted above, removal of the endpiece/sealing-member 122 is at least partially resisted by the body flange's 116 capture of a portion 134 of the endpiece/sealing-member 122, internal pressure can ultimately exert a tension force on the tear strip portion 132, which, if large enough, could result in undesired (premature) rupture of the tear strip, particularly at the score lines 138, 142 or other weakened portions. A similar force (although oppositely directed) may occur if the contents of the container are under partial vacuum ("vacuum-packed" contents). Accordingly, in the configuration of FIG. 1, when the container shown in FIG. 1 is used for pressurized or vacuum-packed contents, the tear-strip portion 132 may need to be configured to withstand the resulting force, without prematurely rupturing, such as by using a higher-strength (e.g. higher tensile strength) material and/or increasing the tearstrip thickness, particularly in the region near the score lines 138, 142. Unfortunately, such a configuration may make it more difficult for the user to rupture or remove the tear strip when desired, and may increase the cost of the container.

Similarly, in the configuration of FIG. 5, pressurized contents can exert a force on the endcap 522 in a direction 553, such that a force is ultimately exerted on the tear strip 562 which can result in premature tearstrip rupture, unless the tearstrip 562 is strengthened in an amount corresponding to the pressurization of the contents.

Figure 7:
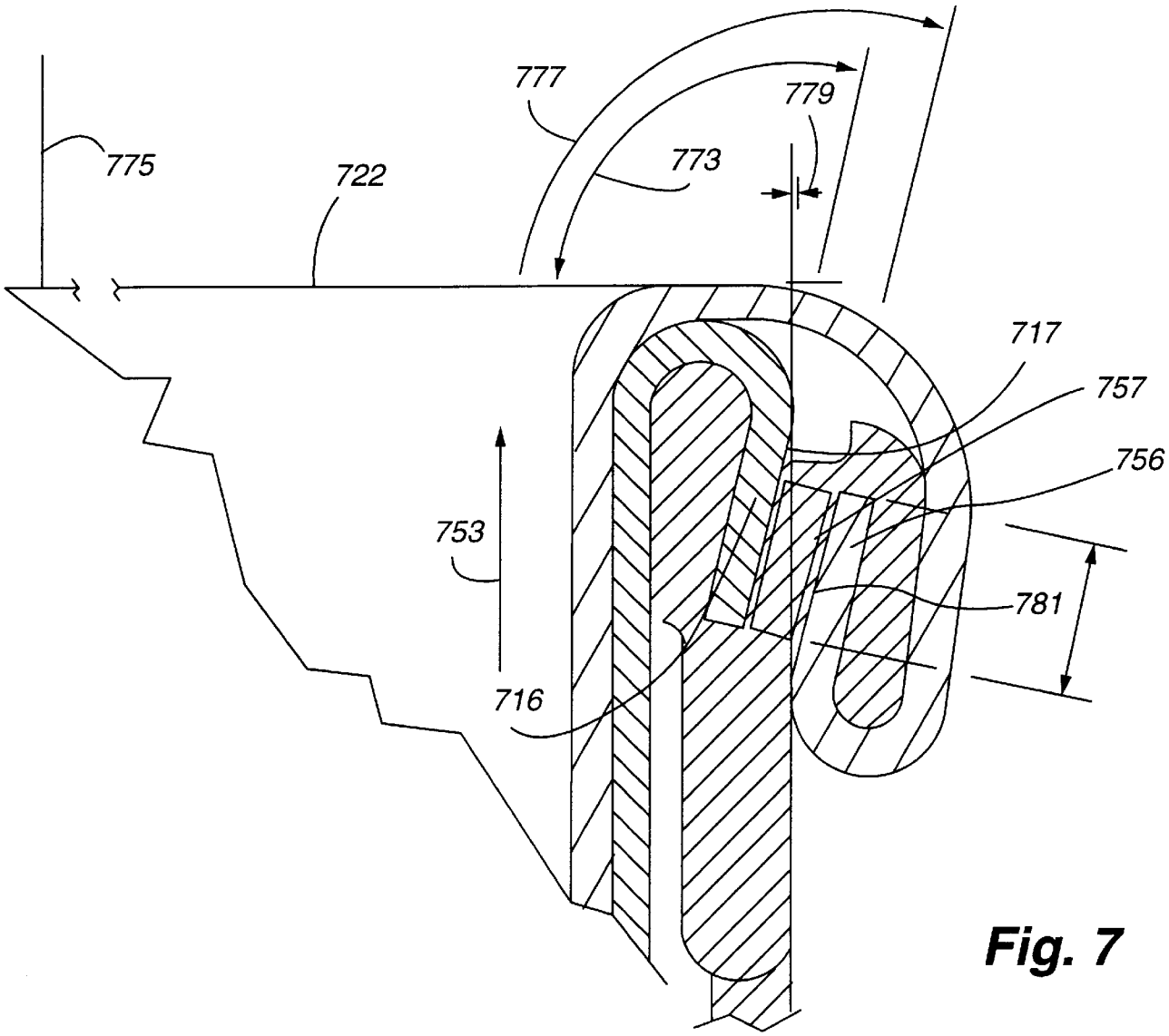
FIG. 7 and FIG. 8 are partial cross-sectional views of containers with end caps and sealing members usable for pressurized contents.

FIG. 7 depicts a configuration which reduces the tensile force on the tearstrip resulting from pressurized contents, thus reducing or avoiding the need for thickened or high-strength tear-strip materials. In the configuration of FIG. 7, the body flange 716 is angled 773 with respect to the longitudinal axis 775 of the container. In particular, in the embodiment of FIG. 7, the outer surface 717 of the body flange 716 lies in or defines an upwardly diverging conical surface. Preferably the endcap flange 756 is also angled, e.g. such that its outer surface 757 is spaced from and substantially parallel to the body flange outer surface 717, as depicted. In the depicted embodiment, the spacing and angles are selected such that, after rupture of the tear strip (substantially as described above in connection with the embodiment of FIG. 2), the endcap 722 may be removed, i.e. there is sufficient radial spacing 779 between (and/or sufficient resiliency in) the endcap 722 and body flange 716 that the endcap may be removed.

Without wishing to be bound by any theory, it is believed that in the configuration of FIG. 7, because of the angle of the body flange 716 and/or the angle of the endcap flange 756, the majority of the force arising from pressurization of container contents is exerted on the substantially flat area 781 of the tear strip. Furthermore, because container pressurization tends to impart a vertically upwardly directed 753 force on the endcap 722, upward movement of or force on the endcap 722 is believed to include a component tending to compress the tearstrip against the outer surface 717 of the body flange (rather than substantially all of the pressurization force resulting in tension on the tear strip). It is believed that, as a result, it is possible to use a relatively weaker material for the tearstrip (that, thus, ruptures more easily) but which still has sufficient strength to withstand high internal pressure (or vacuum). Furthermore, the configuration of FIG. 7 is believed to provide increased resistance to premature rupture that could otherwise result from dropping or other impacts or abuse or from tampering.

A number of variations of the configuration of FIG. 7 can be used. The body flange 716 or flange surface 717 may be curved (in the view of FIG. 7) rather than flat. Although FIG. 7 depicts angling or flaring of both the body flange 716 and endcap flange 756, it is possible to angle or flare only one of such flanges, or to angle or flare the two flanges at different (non-parallel) angles. Although FIG. 7 shows the angles 773, 777 diverging upwardly from the container axis 775, the angles may diverge downwardly, e.g. when container contents are vacuum-packed.

Figure 8:
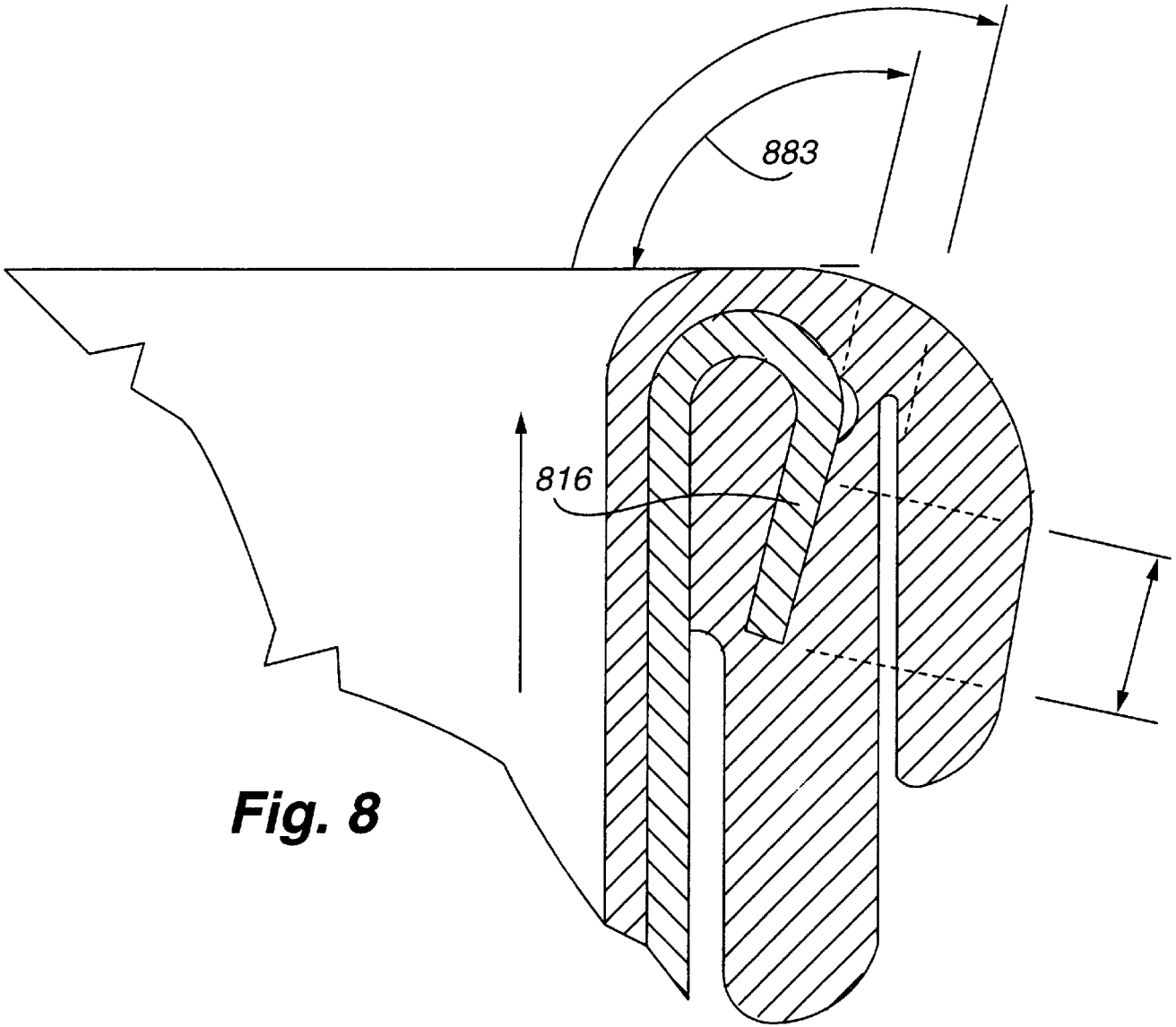

FIG. 8 depicts a configuration similar to that of FIG. 7 e.g. in that the body flange 816 is angled 883, but in which the endcap and sealing strip are integrated (one-piece). The configuration of FIG. 8 is believed to provide at least some of the pressure-containment and other benefits described above in connection with FIG. 7.

In light of the above description, a number of advantages the present invention can be seen. By providing an endpiece/sealing-member which is integrated, manufacturing costs are reduced e.g., by reducing the number of components and the number of process steps or machines needed for producing a container. (Compared to, e.g., container closure which involves separate endpiece and sealing strips.) By providing a integrated closure structure, one potential for a closure structure which is made of a single material is enhanced, significantly increasing the potential for recycling of endpiece/sealing-members. The opened container is substantially free from edges, flanges and the like adjacent the container opening which might impede removal or retrieval of contents. The container provides for ease of use permitting containers which may be readily opened without the use of can openers or other tools but with relatively low risk of premature opening. The device reduces or eliminates exposure of sharp edges as a result of opening the container, thus reducing the potential for injuries.

A number of variations and modifications can also be used. In general it is believed operable to use some features of the invention without using others. For example, it is possible to provide a closure which is integrated with a tear strip without having an outward-turned body flange (or otherwise avoiding impediments to outward flow of container contents). It is possible to provide integration of the endpiece/sealing-member with the tear strip without providing for reclosability of the container.

Although scoring on single surface of the integrated endpiece/sealing-member for a particular rupture line has been depicted, it is possible to use 2 or more scores side-by-side or scores on opposite surfaces for a single rupture line. Rupture patterns can also be provided without using scoring such as by providing for rupturing adjacent edges of flanges or other relatively rigid materials which may thus act as a knife edge or scissor edge. Rupture patterns can be facilitated by providing fibrous material or other re-enforcing material in regions away from the desired rupture lines or embedding wires strings or other materials to be pulled so as to rupture a portion of the integral endpiece/sealing-member. The integral endpiece/sealing-member may be provided with auxiliary opening devices such as spouts, pull tabs or panels and the like. An integral endpiece/sealing-member may be configured so that its upper surface contains sealing or latching members or devices e.g., such that, after removal, the endpiece/sealing-member may be inverted for re-sealing the container. The endpiece/sealing-member may be provided with one or more handles to facilitate tearing the container. Other features materials and processes for container closure described in Ser. No. 08/824,244 (Attorney File No. 1604-162-1) may be adapted for use with the integrated endpiece/sealing strip described herein with appropriate modifications as will be apparent to those skilled in the art after understanding the present invention.

Although in one described embodiment the integral endpiece/sealing-member has been described as formed from a plastic material, other materials may be used including re-inforced or other composite materials, metals, resins, fiberglass, cardboard, ceramics and the like. The integral endpiece/sealing-member can be used in connection with container bodies made of a wide variety of materials including metals, plastics, composites, cardboard, paper, resins, fiberglass, and the like. Although a preferably re-sealable press fit has been described as providing a mechanical purchase between the integral endpiece/sealing-member and the container body, other types of mechanical purchases can be used including snap-lock interconnections, interference fits, screw connections and the like or non-resealability may be provided. The endpiece/sealing-member closure may be used in connection with additional sealing members such as plastic, metal foil, or other sealing sheets or materials. Although the integral endpiece/sealing-member is preferably provided with a lip, e.g., to avoid exposure to the container body flange, an operable integral endpiece/sealing-member can be provided without such a lip, or with a smaller or larger lip than that depicted.

Although a container body flange adjacent an outer upper portion of the remainder of the container body is disclosed, other flange configurations are possible including a flange which flushly engages the upper portion of the sidewall of the container body, a flange disposed radially outward of the upper portion of the sidewall of the container body, and/or flange disposed parallel with the container center axis or angled relative thereto (e.g., in diverging relation to the container center axis).

If desired, the endpiece/sealing-member of the container may include a central panel which is generally dome-shaped, e.g., such that the "public" side of the central panel of the endpiece/sealing-member (i.e., that which defines an exterior surface of the container) is generally convexly shaped. Such configuration may assist in the removal of the endpiece/sealing-member from the container body. In some cases, the interior of the container is substantially at a vacuum (e.g., for certain food product applications), and pressing down on a generally dome-shaped central panel may unseat mechanical purchases to relieve the vacuum within the interior of the container to allow the endpiece/sealing-member to be more easily moved away from the container body to gain access to the contents.

Although, in the depicted embodiment, the tear strip is entirely removed from the endpiece/sealing-member when the container is opened, it is possible to provide for configurations in which some or all of the ruptured tear strip is coupled to or retained by the endpiece/sealing-member or container body. Such a configuration may be useful to avoid creating a separate tear strip member which will need to be disposed of. One way of retaining the tear strip is to configure the integrated endpiece/sealing-member such that score lines are provided along only a portion of the circumferential extent of the endpiece/sealing-member so that, after the user grasps the tear strip handle and pulls the tear strip free for the majority of the circumferential extent, the final circumferential extent remains attached to the integrated endpiece/sealing-member.

Although the depicted embodiment shows an endpiece/sealing-member which may be entirely removed from the container body, it is possible to provide a connection such as a hinged connection so that the endpiece/sealing-member may be pivotally lifted from over a portion of the opening of the container body but remaining coupled thereto, e.g., for ease of resealing. For example, by providing a tear strip which extends around only a part of the circumference, the remaining circumferential portion, continuing to couple the endpieces/sealing member flange to the remainder of the endpiece/sealing-member, can act as a flexible or living hinge.

Although the invention has been described by way of a preferred embodiment and certain variations of modifications, other variations of modifications can also be used, the invention being defined by the following claims:

What is claimed is:

1. A container comprising:

a container body having an open end;

a closure structure having an endcap portion substantially covering said open end, said closure structure including a closure flange and a rupturable tear strip portion which couples said closure flange to said endcap portion;

said closure flange coupled to at least a portion of said container body wherein movement of said endcap portion away from said container body is resisted;

wherein said endcap portion, tear strip portion and closure flange are integrally formed in one piece and;

wherein said container body includes a body flange adjacent said open end and wherein said closure flange is coupled to said container body by being compressed between at least a portion of said body flange and at least a portion of said container body.

2. A container as claimed in claim 1, wherein at least a portion of said rupturable tearstrip has a thickness such that said portion of said tearstrip extends radially inward beyond said body flange.

3. A container as claimed in claim 1, wherein said body has a longitudinal axis and wherein said body flange defines an angle diverging from said longitudinal axis.

4. A container, as claimed in claim 1, wherein rupture of said rupturable tear strip at least partially uncouples said closure flange from said endcap portion to permit movement of at least said endcap portion away from at least a portion of said open end of said container body.

5. A container, as claimed in claim 1 wherein said rupturable tear strip is at least partially defined by a weakened region.

6. A container, as claimed in claim 1 wherein said open end defines a body opening perimeter, said tear strip is located adjacent at least a portion of said perimeter and wherein said rupturable tear strip is at least partially defined by a score line extending at least partially around said perimeter.

7. A container, as claimed in claim 1, further comprising a handle, coupled to said tear strip.

8. A container, as claimed in claim 1, further comprising a lip positioned outward of said tear strip.

9. A container, as claimed in claim 1, wherein said endcap is removably couplable to said container body without the need for said tear strip, to permit reclosability of said container body.

10. A container, as claimed in claim 1, wherein said closure structure effects a sealed closure of said open end of said container body.

11. A container, as claimed in claim 10, wherein said sealed closure forms a seal selected from the group consisting of a water-tight seal, a gas-tight seal, a pressure-tight seal and an vacuum-tight seal.

12. A container comprising:

a container body having, an open end;

closure means having an endcap portion for substantially covering said open end;

closure flange means, integral with said closure means, for effecting a first coupling to at least a portion of said container body wherein movement of said endcap portion away from said container body is resisted;

rupturable tear strip means, integral with said closure means, for effecting a second coupling of said endcap portion to said closure flange means;

said endcap portion, said tear strip means and said closure flange means are integrally formed in one piece;

wherein said container body includes a body flange adjacent said open end and wherein said closure flange means is coupled to said container body by being compressed between at least a portion of said body flange and at least a portion of said container body.

13. A container, as claimed in claim 12, further comprising:

means for facilitating rupture of said rupturable means.

14. A container, as claimed in claim 12, further comprising means for facilitating rupture of said rupturable means along a predefined path.

15. A container as claimed in claim 12 wherein said means for substantially covering includes means for coupling to said container body without the need for said tear strip, to permit reclosability of said container body.

16. A method for fabricating a closed container from a container body which defines at least a first opening, comprising:

integrally forming in one piece a closure with an endcap, an integral closure flange and an integral, rupturable tearstrip portion coupling said endcap to an integral closure flange;

coupling said integral closure flange to said container body to retain said endcap in a position substantially covering said first opening wherein movement of said endcap away from said container body is resisted;

wherein said container body includes a body flange adjacent said first opening and wherein said closure flange is coupled to said container body by being compressed between at least a portion of said body flange and at least a portion of said container body.

17. A container comprising:

a container body having a bottom and a sidewall portion defining an open end, said container body having a longitudinal axis;

a body flange adjacent said open end, said flange radially outward, with respect to said longitudinal axis, of said sidewall portion to define a first space between said sidewall portion and said body flange;

a closure structure having an endcap portion substantially covering said open end, said closure structure including a closure flange and a rupturable tear strip portion which is joined to both said closure flange and to said endcap portion, said tear strip portion defined by a first score where said tear strip portion joins said endcap portion and a second score where said tearstrip portion joins said closure flange;

said closure flange compressed in said first space to be substantially immovable with respect to said container body wherein movement of said endcap portion away from said container body is resisted by said closure flange until said tear strip is ruptured along said first and second score lines;

wherein said endcap portion, tear strip portion and closure flange are integrally formed in one piece.

18. A container comprising:

a container body defining a longitudinal axis and having a bottom wall;

an upstanding sidewall portion defining a container interior, said sidewall portion having a first edge joined to said bottom wall and a second opposite edge, said second edge being turned downward and radially outward, with respect to said longitudinal axis to define a body flange said body flange and a portion of said sidewall forming an inverted U shaped cross section, the apex of said inverted U shaped cross-section forming a body rim defining an open end of said container body, said open end having a perimeter, said inverted U shaped cross section defining a first annular space; an integral endcap having;

a first wall extending across said container interior below said body rim;

a second wall extending upward from said first wall substantially adjacent an interior portion of said sidewall, and having an upper edge turned radially outward to form an endcap rim adjacent and above said body rim;

a lip extending downwardly from said rim;

an annular tearstrip portion extending downward from said endcap rim and positioned substantially radially outward of said body flange and radially inward of said lip;

an annular endcap flange extending upwardly and radially inwardly from said tearstrip portion, compressed into said first annular space to be retained therein;

a handle extending downward from said tearstrip portion; and first and second scores located where said tearstrip joins said endcap rim and said endcap flange respectively and extending at least partially along said perimeter to define rupture pathways for at least partially separating said tearstrip from said endcap flange and said endcap rim, permitting movement of said first wall, second wall, lip and rim at least partially away from said open end.

* * * * *